United States Patent [19]

Kasai

[11] Patent Number: 4,639,982

[45] Date of Patent: Feb. 3, 1987

[54] RELEASABLE BUCKLE

[75] Inventor: Kazumi Kasai, Namerikawa, Japan

[73] Assignee: Nippon Notion Kogyo Co., Ltd., Tokyo, Japan

[21] Appl. No.: 728,149

[22] Filed: Apr. 29, 1985

Related U.S. Application Data

[63] Continuation of Ser. No. 478,168, Mar. 23, 1983, abandoned.

[30] Foreign Application Priority Data

Mar. 23, 1982 [JP] Japan ..... 57-40577[U]
Oct. 9, 1982 [JP] Japan ..... 57-153791[U]

[51] Int. Cl.[4] ..... A44B 11/25
[52] U.S. Cl. ..... 24/616
[58] Field of Search ..... 24/171, 181, 614–616, 24/618, 625

[56] References Cited

U.S. PATENT DOCUMENTS

| | | | |
|---|---|---|---|
| 1,326,055 | 12/1919 | Hirsch | 24/616 |
| 1,599,016 | 9/1926 | Johnson et al. | 24/616 |
| 2,908,953 | 10/1959 | Anderson | 24/616 X |
| 3,543,356 | 12/1970 | Zimmermann | 24/616 X |
| 4,150,464 | 4/1979 | Tracy | 24/615 X |

FOREIGN PATENT DOCUMENTS

| | | | |
|---|---|---|---|
| 689501 | 6/1964 | Canada | 24/616 |
| 44639 | 1/1982 | European Pat. Off. | 24/618 |
| 1398165 | 3/1965 | France | 24/616 |
| 2451175 | 11/1980 | France | 24/616 |
| 686243 | 3/1965 | Italy | 24/616 |
| 55-20939 | 2/1980 | Japan . | |
| 586027 | 3/1977 | Switzerland | 24/616 |

*Primary Examiner*—Kenneth J. Dorner
*Assistant Examiner*—James R. Brittain
*Attorney, Agent, or Firm*—Hill, Van Santen, Steadman & Simpson

[57] ABSTRACT

A buckle comprises a male and a female member releasably engageable therewith. The junction between the male and female members is substantially closed or minimized to prohibit intrusion or accumulation of foreign matters. The male member includes a gripping ear for manipulation by fingers which is located beyond the width of the female member.

3 Claims, 10 Drawing Figures

RELEASABLE BUCKLE

This is a continuation of application Ser. No. 478,168, filed Mar. 23, 1983, now abandoned.

FIELD OF THE INVENTION

This invention relates to a buckle for fastening loose ends of a belt or strap applied to garments, bags and the like.

PRIOR ART

There have been proposed many forms of buckle designed to releasably connect loose ends of a belt, strap and the like.

A typical example of such known buckle comprises a male or plug member and a female or socket member, the male member having a locking part resiliently insertable into an opening in the female member, whereby the two members can be snapped into and out of engagement with each other. To effect this snapping engagement, the male member which is usually made of a plastic or other resilient material, has a slit or cutout defined between the body and the locking part. This slit or cutout as embodied in a prior art buckle structure such as are disclosed in Japanese Utility Model Laid-Open Publication No. 55-20939 is exposed to view when the buckle members are coupled together with the results that threads, dust or other foreign matters are prone to get into the female member through the slit, or the slit would often catch a garment or the like and cause damage to the buckle. Such prior art structures are not only unsightly but have a drawback in that a special molding technique is required to form the female member which is internally complexly contoured.

SUMMARY OF THE INVENTION

In a buckle of the present invention, a plug part of a male member, which part is releasably coupled with a socket of a female member, has a T-shaped stem, a pair of elastically deformable upturns extending from opposite bottom corners of the stem, and a pair of gripping ears disposed outwardly of respective upper end portions of the upturns and connected thereto by a pair of connecting portions, respectively, of a reduced thickness smaller than the thickness of the stem, the upturns and the gripping ears. The socket part has an opening receptive of the plug part, and two pairs of flanges disposed one pair at each side of such open end so as to provide between each opposed pair of the flanges a restricted side slit. The restricted side slit has a width substantially equal to the thickness of the connecting portions so that a respective one of the connecting portions is received through the restricted side slit when the plug and socket parts are coupled together. Each flange has on its lower side an abutment engageable with an upper end of a respective one of the upturns when the plug and socket parts are coupled together.

It is an object of the invention to provide a buckle having a female member which can be produced in a simple manner.

Another object of the invention is to provide a buckle in which engaging portions of a male member have an increased degree of strength.

Still another object of the invention is to provide a buckle having a unique structure which does not permit virtually any dust to enter it.

A further object of the invention is to provide a buckle in which male and female members, when assembled, are retained stably in position against displacement.

These and other objects and features of the invention will be better understood from the following description taken in conjunction with the accompanying drawings which illustrate by way of example a preferred embodiment of the invention.

BRIEF DESCRIPTION OF THE DRAWINGS

Like reference numerals refer to like parts throughout the several views.

DETAILED DESCRIPTION OF THE PREFERRED EMBODIMENT

Figure 6:
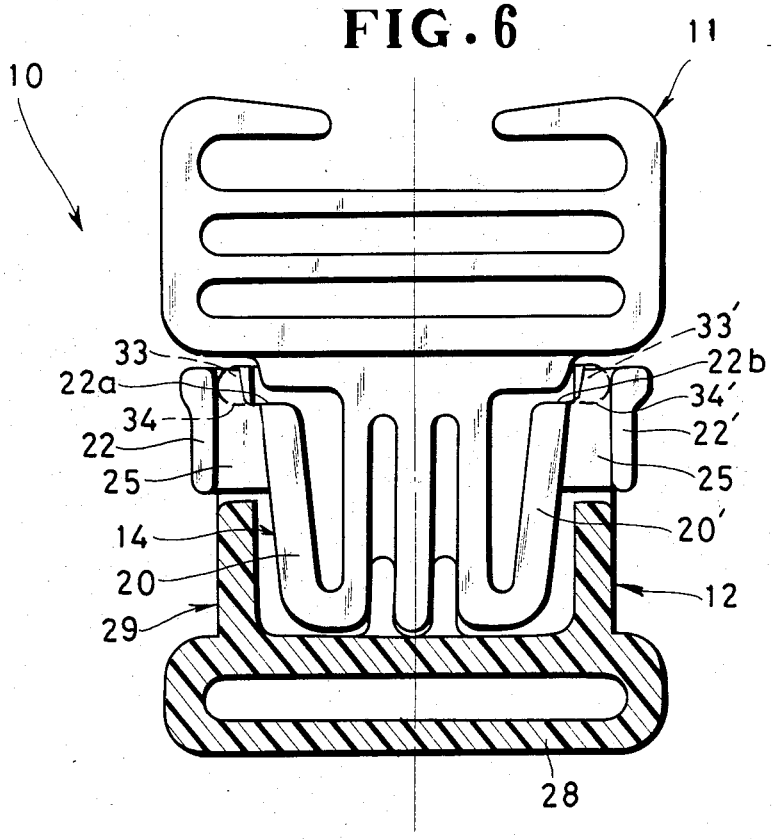
FIGS. 6 and 7 each are a plan view of the male and female members of the buckle shown engaged or connected.
Figure 7:
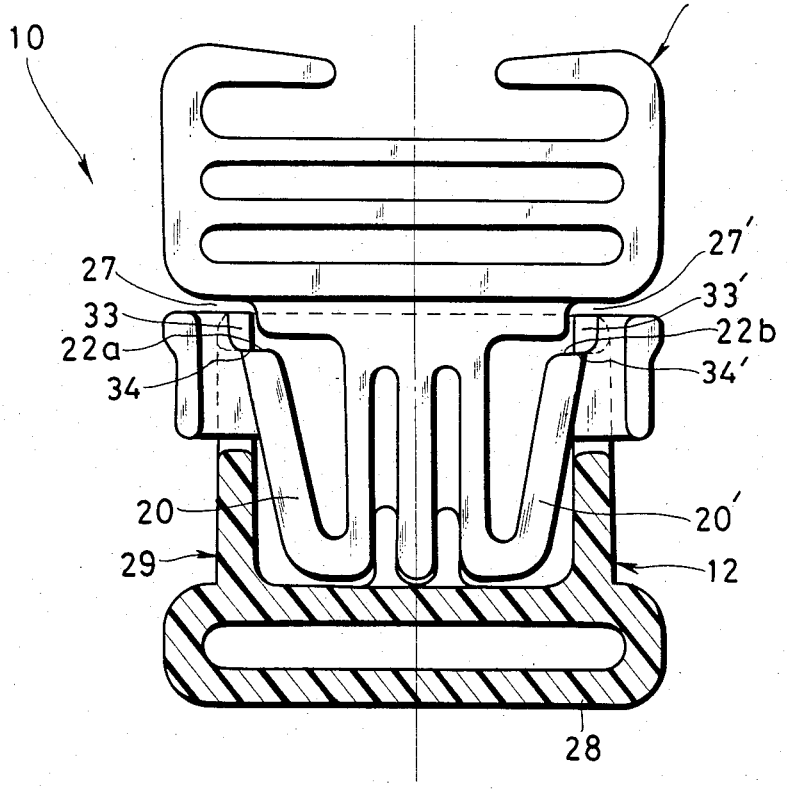

In FIG. 6 or FIG. 7 in particular, there is shown a buckle 10 embodying the invention which is made of synthetic resin and generally comprises a male or plug member 11 and a female or socket member 12, the two members being releasably coupled.

Figure 1:
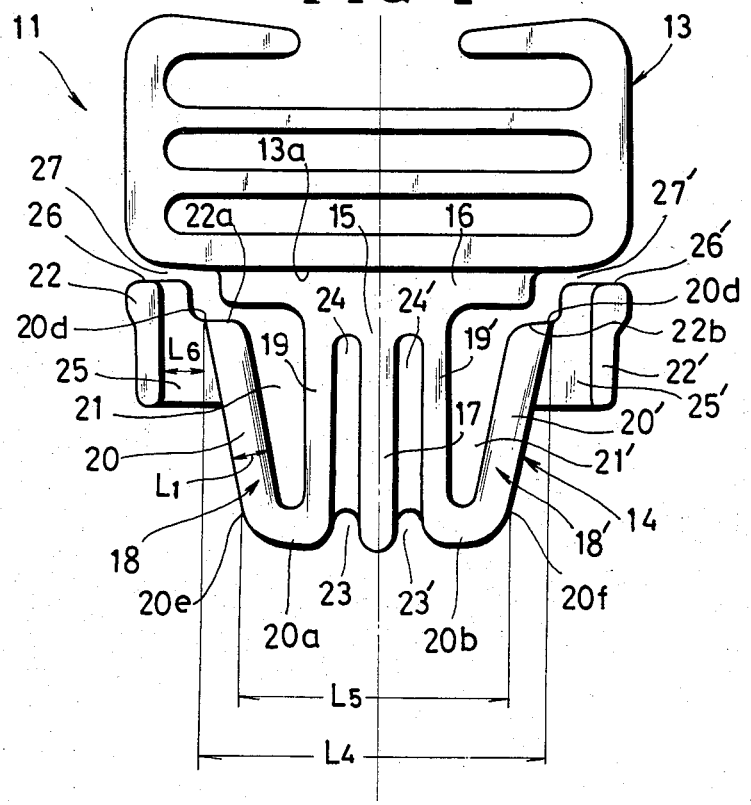
FIG. 1 is a plan view of a male or plug member which constitutes one part of a buckle embodying the invention.

The male member 11 as better shown in FIG. 1 comprises a first belt-end retainer portion 13 for retaining thereon one end of a belt-like article in a well known manner, and a plug portion 14 integral with the retainer portion 13 and insertable into the socket member 12. The plug portion 14 has a generally T-shaped stem portion 15 including a horizontal region 16 contiguous with a bottom end of the retainer 13 and a rib 17 extending perpendicularly from and centrally of the region 16. The plug 14 also includes a pair of generally V-shaped engaging portions 18,18' which have uprights 19,19' respectively extending from the horizontal region 16 and lying on opposite sides of the rib 17 and which have upturns 20,20' upwardly extending divergently from the uprights 19,19' via respective turnovers or corners **20*a*,20*b* and terminating slightly short of the opposite ends of the horizontal region 16 defining with the uprights 19,19' triangular slits 21,21'. For manipulation to release or disconnect the male member 11 from the female member 12, a pair of gripping ears 22,22' is disposed outwardly of respective upper end portions of the upturns 20,20' and is connected thereto by a pair of connecting portions 25,25' respectively, of a thickness $L_3$ (FIG. 2) smaller than the thickness of the gripping ears 22,22'. Each upturn 20,20' has an upwardly obliquely extending outer surface on and along which a socket portion 29 (FIG. 3) is guided while the plug and socket portions 14,29 are being coupled together. During that time, pressing force is exerted on the outer surfaces of the upturns 20,20'**, thus causing the latter to be elastically deformed as described below.

A pair of recesses 23,23' is provided between the rib 17 and the uprights 19,19'. Two pair of elongated grooves 24,24' are disposed in both the top and bottom surfaces of the uprights 19,19' in communication with the recesses 23,23', lying parallel with the projection 17, and terminating adjacent to the horizontal region 16 of the T-shaped stem portion 15.

Figure 2:
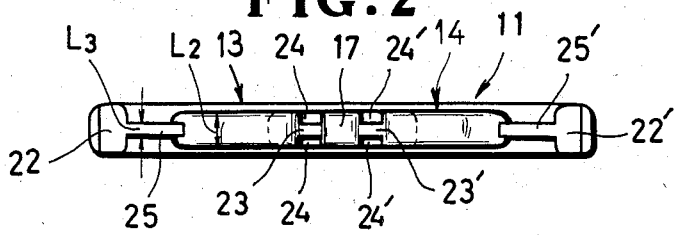
FIG. 2 is an end view of the male member.

As shown in FIG. 2, the thicknesses $L_2$ of the T-shaped stem 15 and of the engaging portions 18,18' are substantially equal; the gripping ears 22,22' and the retainer 13 are substantially equal in thickness, which is slightly greater than the thickness $L_2$. The connecting portions 25,25' have a thickness $L_3$ smaller than the thickness $L_2$ and are disposed centrally, in the facewise direction, of the gripping ears 22,22' and the engaging portions 18,18'. An upper surface of each connecting portion 25,25' is stepped and hence has a first surface section contiguous to the upper end **22*a*,22*b* of a respective one of the upturns 20,20', and a second surface section raised from the first surface section and contiguous to the upper end 26,26' of the respective gripping ears 22,22'. The upper end 26,26' of the gripping ears 22,22' is disposed close to the bottom end 13*a* of the first retainer 13. The upper end surfaces 22*a*,22*b* of the upturn 20,20', of the connecting portion 25,25' and of the gripping ear 22,22' define with the bottom end 13*a* of the first retainer 13 and the horizontal region 16 of the T-shaped stem 15 a restricted, generally S-shaped gap 27,27'**.

Figure 3:
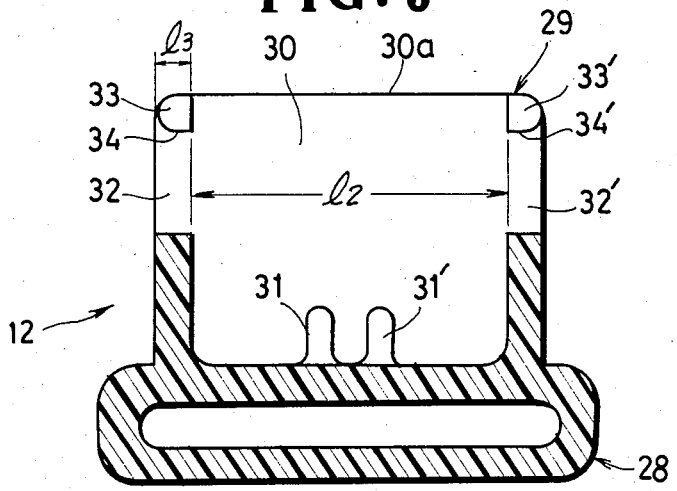
FIG. 3 is a partly cross-sectional, plan view of a female or socket member which constitutes the other part of the buckle.
Figure 4:
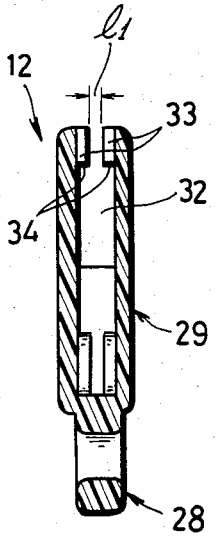
FIG. 4 is a partly cross-sectional, side elevation of the female member.
Figure 5:
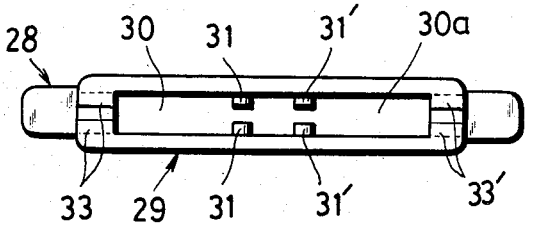
FIG. 5 is an open end view of the female member.

In FIG. 3, there is shown a female or socket member 12 which comprises a second belt-end retainer portion 28 for retaining thereon the other end of the belt-like article, and a socket portion 29 having an opening 30 for receiving the plug portion 14 of the male member 11.

Two pair of engaging lugs 31,31' extend from both the upper and lower inner walls of the socket 29 and are directed toward the open end **30*a* of the opening 30. The engaging lugs 31,31' are spaced to register in position with the grooves 24,24' respectively of the male member 11. The socket 29 has a pair of side slits 32,32', one on each side, which are each reduced in width at the open end 30*a* by the presence of a pair of flanges 33,33'. Each of the flanges 33,33' has on its lower side an abutment 34,(34') for abutting engagement with the upper end 22*a*,(22*b*) of the upturn 20,(20') of the male member 11 The restricted side slit or spacing $l_1$ between the flanges 33,33' on each side of the socket 29 is smaller than the thickness $L_2$ of the engaging portion 18,(18') of the male member 11 and is larger than the thickness $L_3$ of the connecting portion 25,(25') of the male member 11**.

The width $l_2$ of the opening 30 is smaller than the spacing $L_4$ between opposite outer upper terminal edges **20*c* and 20*d* of the upturns 20,20' but is larger than the spacing $L_5$ between opposite outer lower edges 20*e* and 20*f* of the upturns 20,20'**.

The transverse width $l_3$ of the flange 33,(33') is smaller than the width $L_6$ of the connecting portion 25,(25').

With this construction, the buckle 10 may be operated in the manner in which the plug part 14 of the male member 11 is inserted into the socket part 29 of the female member 12. In this instance, because of the dimensional arrangements of the various parts above described, the inner walls of the flanges 33,33' of the female member 12 are brought into engagement first with the outer edges of the upturns 20,20' of the male member 11, whereupon the upturns 20,20' are urged to flex resiliently about the turnovers **20*a*,20*b* inwardly toward the rib 17. Further advancing the male member 11 causes the connecting portion 25,25' to move between and past the two flanges 33,33' of the socket 29. As the plug 14 moves in further until the abutment 34,(34') of the flange 33,(33') is located above the upper end 22*a*,(22*b*) of the upturn 20,(20'), the outer edge of the upturn 20,(20') is disengaged from the inner wall of the flanges, the moment of this engagement being shown in FIG. 6, thus enabling the plug part 14 to expand to its original free position as illustrated in FIG. 7. In this position, because the width $l_2$ of the socket 29 is smaller than the spacing $L_4$ of the upturns 20,20', the upper end 22*a*,(22*b*) of the upturn 20,(20') in the male member 11 is brought partially into abutting engagement beneath the abutment 34,(34') of the flange 33,(33') of the female member 12, thereby locking the male and female members 11,12** in coupled condition.

As shown in FIG. 7 in particular, the gaps between the male and female member 11,12 when coupled together are substantially closed or minimized so that foreign matter is prevented from entry through or deposit at the slits 27,(27') that are restricted. Also advantageously, since when the gripping ears are pressed by fingers, the extent to which each gripping ear is pressed is restricted at the position where the inner edge of the gripping ear and the outer edge of the flange come into engagement with one another. Thus it is possible to minimize the extent to which the engaging portions and particularly the upturns are to be deformed, thus preventing the upturns from being excessively deformed. Accordingly a good durability of the plug member is guaranteed. Further, the socket member has such a simple structure that it can be produced on a simple mold with maximum ease.

Figure 8:
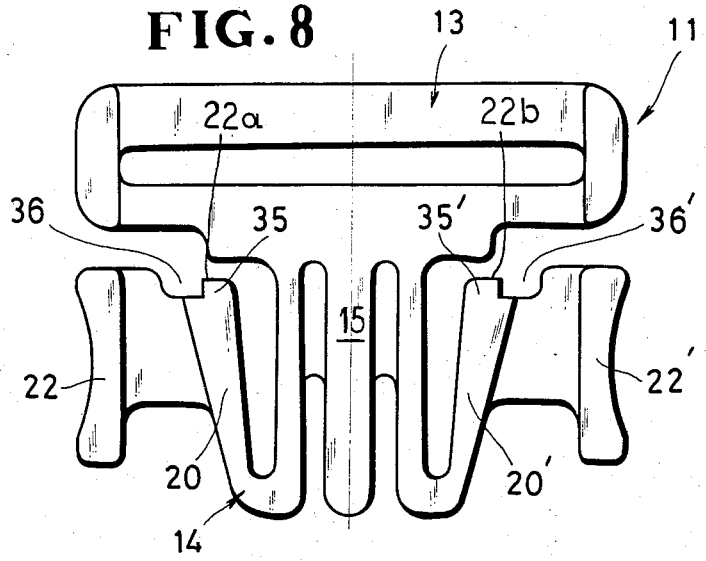
FIG. 8 is a plan view of a modified form of male member.
Figure 9:
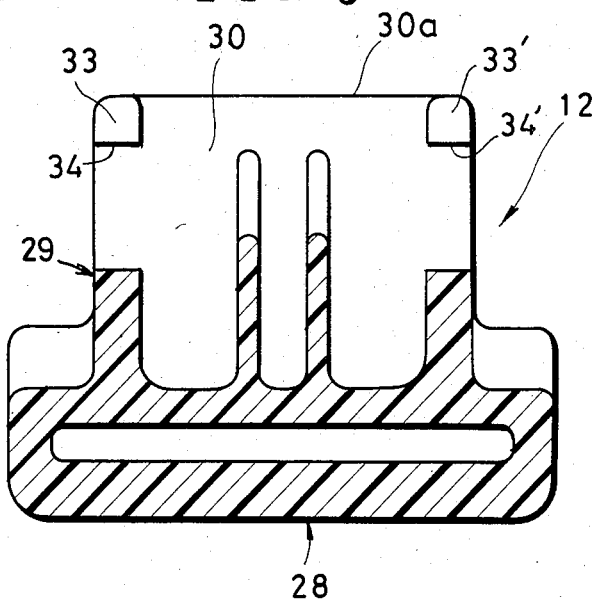
FIG. 9 is a plan view of a modified form of female member.
Figure 10:
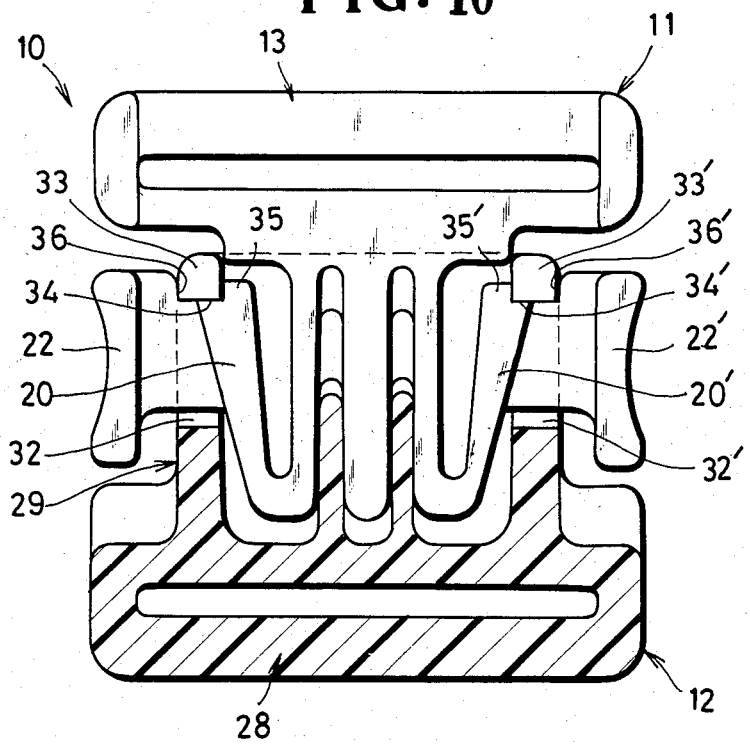
FIG. 10 is a plan view of the modified male and female members of the buckle shown engaged or connected.

FIGS. 8 through 10 show a modified form of buckle embodying the invention. This modification differs by the provision of an upwardly projecting lug 35,(35') which extends from and above the upper end **22*a*,(22*b*) of the upturn 20,(20') in the male member 11 to define with the connecting portion 25,(25') a recess 36,(36') dimensioned and contoured to receive the flange 33,(33') of the female member 12 during the coupling operation of the buckle 10. The lugs 35,35' have a thickness equal to the thickness of the upturns 20,20', and each lug 35,35' extends from the inner side (the side nearer the stem 15) of the upper end 22*a*,(22*b*) of the upturn 20,(20'). This arrangement provides more assured locking of the male member 11 with the female member 12 as shown in FIG. 10; the male and female members are thus maintained coupled together without lateral displacement even when undue stress is exerted on the members. The embodiment thus illustrated in FIGS. 8 through 10** inclusive is exemplary of modifications and changes that may be made in the basic form of the invention.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A buckle for fastening ends of a flat belt-like article, comprising:

A. A male member molded of synthetic resin as one piece including (1) a first belt-end retainer portion adapted to be connected to one end of the flat belt-like article, and (2) a plug portion having (a) a generally T-shaped stem having a horizontal portion integral with said first retainer portion, and a vertical portion perpendicular thereto, said vertical portion of said stem further having a pair of guide recesses extending from the distal end of said vertical portion toward said horizontal portion and terminating substantially midway along its length;

(b) a pair of resilient upturns extending from opposite corners of the distal end of said stem, each of said upturns having a lug projecting upwardly at its distal end so as to define with the later a locking recess at the outer side of said lug;

(c) a pair of thinner connecting portions each extending outwardly from an outwardly facing side of the respective upturn and terminating in an enlarged gripping ear; and B. A female member molded of synthetic resin as one piece including (1) a second belt-end retainer portion adapted to be connected to the other end of the flat belt-like article; and (2) a socket portion having (a) means defining a socket-opening at one end of said socket portion receptive of said plug portion and also defining a pair of side slits communicating with said socket-opening, said means having a pair of first and second inner walls, said means of said socket portion further having a pair of guide projections extending between said inner walls, said guide projections extending from the bottom of said socket opening toward the open end of said socket opening and terminating substantially midway between said bottom and said open end, each of said guide projections being receivable in a respective one of said guide recesses in said vertical portion of said stem when said plug portion is received in said socket opening; and (b) two pairs of inwardly facing flanges disposed one pair at each side of said socket-opening, each said pair of flanges defining therebetween a restricted slit communicating with both said socket-opening and one of said side slits for passage therethrough of a respective one of said connecting portions, each said restricted slit having a width greater than the thickness of each said connecting portion and smaller than the thickness of either of said lug and said upturn so that each pair of said flanges is received in one of said locking recesses, each said flange having a first abutment facing one of said side slits for engagement with said distal end of one of said upturns to restrict the movement of said male and female members away from each other, and a second abutment facing said socket-opening for engagement with said lug of one of said upturns to restrict the outward movement of said distal end and hence to prevent said respective upturn from being overbent outwardly.

2. A buckle according to claim 1, said vertical portion of said stem having on each side thereof a pair of elongated grooves jointly defining with said guide recesses a rib extending from the distal end of said stem substantially to said horizontal portion, said means having on each of said guide projections a pair of engaging lugs extending from free ends of said guide projections toward the open end of said socket opening and terminating short thereof, each said pair of engaging lugs being receivable in said grooves on each side of said vertical portion of said stem when said plug portion is received in said socket opening.

3. A buckle according to claim 1, each of said upturns of said male member tapering outwardly in thickness at its outer side to a widest dimension at its distal end, said side slits of said female member being elongated and receptive of the upper ends of said tapered upturns.

* * * * *